United States Patent [19]

Wards

[11] Patent Number: 4,789,470

[45] Date of Patent: Dec. 6, 1988

[54] SKIMMER-DIVERTER ASSEMBLY FOR REMOVING DEBRIS FROM SWIMMING POOLS AND THE LIKE

[76] Inventor: John F. Wards, 402 Bunker Hill Dr., Pensacola, Fla. 32506

[21] Appl. No.: 86,508

[22] Filed: Aug. 18, 1987

[51] Int. Cl.[4] ..... E04H 3/20

[52] U.S. Cl. ..... 210/169; 210/242.1; 4/490

[58] Field of Search ..... 210/169, 416.1, 242.1, 210/242.3; 15/1.7; 134/167 R; 4/490

[56] References Cited

U.S. PATENT DOCUMENTS

| | | | |
|---|---|---|---|
| 3,152,076 | 10/1964 | Kreutzer | 210/169 |
| 3,764,015 | 10/1973 | Rolfson | 210/242.1 |
| 3,774,767 | 11/1973 | Field | 210/169 |
| 4,089,074 | 5/1978 | Sermons | 4/490 |
| 4,379,749 | 4/1983 | Roth | 210/169 |
| 4,455,695 | 6/1984 | Mikhel | 210/169 |

*Primary Examiner*—Richard V. Fisher
*Assistant Examiner*—Coreen Y. Lee
*Attorney, Agent, or Firm*—Birch, Stewart, Kolasch & Birch

[57] ABSTRACT

A skimmer-diverter assembly for removing floating debris in a swimming pool has an elongated arm portion with a first flow diverter to establish a flow upwardly and inwardly along the upstream side of the arm, and a second diverter on the end of the arm to enhance the flow inwardly along the downstream side of the arm.

22 Claims, 3 Drawing Sheets

SKIMMER-DIVERTER ASSEMBLY FOR REMOVING DEBRIS FROM SWIMMING POOLS AND THE LIKE

FIELD OF THE INVENTION

This invention relates to skimmer devices for removing floating and slightly submerged debris from swimming pools and more particularly, to a skimmer-diverter assembly which cooperates with the water circulating and filtration system of a swimming pool to divert debris into the pool skimmer intake port with enhanced efficiency.

BACKGROUND OF THE INVENTION

Keeping a swimming pool free of debris is a primary nuisance associated with pool ownership. Many swimming pools include automatic or built in circulating and filtration systems which cause the pool water to circulate either continuously or over extended intervals. These systems are provided with a skimmer intake such that floating debris passing near the skimmer intake of such systems is sucked into that intake and collected in a trap. The trap is then periodically cleaned in a conventional manner.

In conventional systems, floating debris caught in the circulating current of the system readily bypasses the skimmer intake unless it is close enough to be sucked into that intake. The skimmer intake is usually defined in the pool wall and extends from above the surface to a short distance below the surface to enable it to ingest floating debris.

Diverter devices which extend outward from the pool wall adjacent to skimmer intakes for the purpose of enhancing the collecting of floating debris are known in the prior art. By way of example, debris diverter arms cooperating with skimmer intakes in swimming pools having circulation and filtration systems are shown in U.S. Pat. Nos. 3,152,076 to Kreutzer, issued Oct. 6, 1964; 3,244,284 to Shaffer, issued Apr. 5, 1966; 3,774,767 to Field, issued Nov. 7, 1973; 4,068,327 to Heinlein, issued Jan. 17, 1978; 4,221,662 to Joseph, issued Sept. 9, 1980, 4,225,436 to Cseh, issued Sept. 30, 1980; 4,379,749 to Roth, issued Apr. 12, 1983; and 4,455,695 to Mikhel. This litany of patents illustrates the ongoing and long felt need in the art for a skimmer-diverter assembly of enhanced efficiency and simplicity of utilization. The simplicity of utilization also involved the problem of having to remove such diverter assemblies from the pool. Coworsely, if such diverter arm assemblies remain in the pool then there is a concern that this will impair a swimmer's use of the pool.

It is, therefore, an object of the present invention to provide a new and novel skimmer-diverter arm assembly of enhanced efficiency.

Another object of the present invention is to provide a new and novel skimmer-diverter arm assembly which is self-retracting to a position which will preclude impairment of the use of the pool.

These and other objects of the invention will become more fully apparent with reference to the following specification and drawings which relate to preferred embodiments of the present invention.

SUMMARY OF THE INVENTION

The present invention provides a skimmer-diverter assembly for swimming pools and the like in which a water circulation and filtration system is present having a skimmer intake at a side wall of the pool and in which the circulation system has established a flow direction of water circulation. An elongated floating arm portion is provided having one end adapted to be positioned adjacent the downstream side of the skimmer intake and having an opposite end. A mounting means for the assembly such as a pivot structure or hinge is provided at the said one end of the arm portion and the skimmer intake to permit the other end of the arm portion to assume positions away from and adjacent to the sidewall of the pool. An operative position of the assembly is assumed when the arm portion is at an acute angle to the flow direction of the circulating water in the pool. A retracted position of the assembly is assumed when the other end of the arm portion is adjacent the side wall of the pool downstream from the skimmer intake.

A first flow directing means is provided on the floating arm portion and extends from a position above the water surface to a position below the water surface to constrain circulating water to flow both upward and inward along the arm portion into the skimmer intake, entraining floating debris and causing it to be carried toward and ingested by the said skimmer intake.

A second flow directing means is provided on said other end of said arm portion to enhance the flow inward along the upstream side of the arm portion provided by the first flow direction means and also constrain the circulating water in the pool to flow along the downstream side of the arm portion to entrain floating debris and force it toward the side wall of the pool. A retraining means is provided to maintain the assembly in the operative position. The second flow directing means is formed, however, with a flow gate in its leading edge and internal surfaces, as to react with the flow of water in the pool, upon release of the restraining means, to force the whole assembly to pivot about the mounting means and assume the retracted position.

DETAILED DESCRIPTION OF THE DRAWINGS

Figure 1:
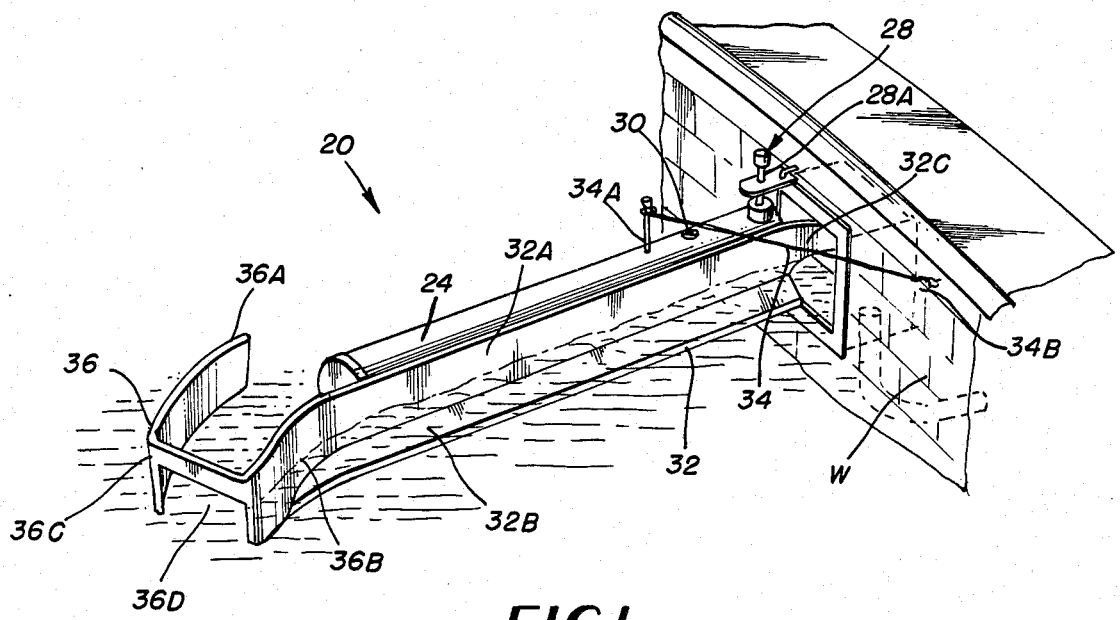
FIG. 1 is a perspective of a skimmer-diverter assembly of the present invention.
Figure 2:
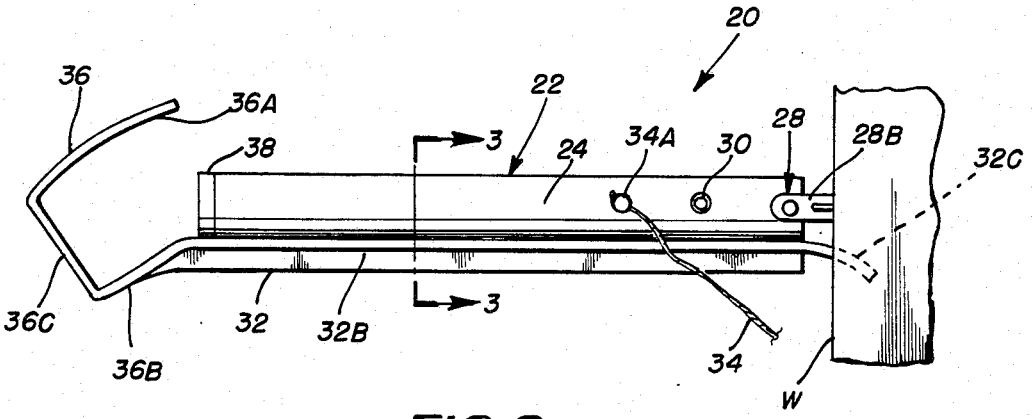
FIG. 2 is a top plan view of a preferred embodiment of the present invention.

Referring in detail to the drawings and with particular reference to FIGS. 1 and 2, the skimmer-diverter assembly 20 of the present invention is shown as including a floating arm portion 22 comprised of a floating ballast boom 24 extending substantially the entire length of the arm portion 22 and having one end 26 pivotally connected to the wall W of a swimming pool or the like by means of a hinge assembly 28. As will be hereinafter more fully described, the hinge assembly 28 permits two degrees of freedom, one of flotation in a vertical direction and a pivotal movement in a horizontal plane, e.g., a plane parallel to the surface of the water in the swimming pool in which the skimmer-diverter assembly 20 is positioned. Both he inge assembly 28 and the pool wall W are shown schematically in FIG. 2 with the pool wall W being shown in FIG. 1.

The floating ballast boom 24 is provided with drilled holes or the like in the lowermost portion thereof and an air bleed valve 30 in the upper surface thereof to permit air to be bled from the ballast boom 24 to thereby predetermine the depth of flotation of the entire assembly 20 with respect to the surface of the water in a swimming pool.

Figure 3:
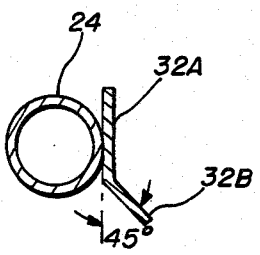
FIG. 3 is a cross-section taken along line 3—3 of FIG. 2 illustrating the angular relationships of the above-and below surface portions of the elongated deflection surfaces of the skimmer-diverter arm in the present invention.

Substantially coextensive with the length of the ballast boom 24 is a first flow directing diverter fin 32 having a vertical disposed and horizontally extending upper portion 32A and an angled substantially coextensive lower portion 32B. The lower portion 32B, as shown in FIG. 3, is angled in a preferred configuration at 45 degrees to the vertical and extends away from the ballast arm 24. As will be hereinafter more fully described this is for the purpose of intercepting the skimmer current caused by the circulation system in the pool to cause flow diversion upward along the entire length of the first diverter fin 32 on the floating boom assembly 22. Also, as will hereinafter be more fully described, the vertically disposed, horizontally extending upper portion 32A of the first diverter fin 32 directs flow inward from the outermost tip of the arm assembly 22 towards the wall W of the swimming pool when the skimmer-diverter assembly 20 is in what will be defined as its operating position.

A further innermost curved portion 32C is provided as an extension of the upper diverting surface portion 32A of the first diverting fin 32 for the purpose of extending a flow diverting surface into the pool skimmer trap.

In order to place the entire skimmer-diverter assembly 20 into operative position there is provided a flexible cable or link 34 which extends from a fixed post 34A on the upper surface of the ballast boom 24 to a fixed position 34B on the pool wall W, such that by varying the length of the flexible lines 34 a particular angle of the floating arm assembly 22 with respect to the pool wall W can be achieved to define an operating position for the skimmer-diverter assembly 20.

The skimmer-diverter assembly 20 is completed by a second diverter means comprising a concave/convex compound second diverter fin 36 having vertically disposed surface portions extending horizontally outward and backward around the outer end 38 of the floating arm assembly 22 and ballast boom 24 such that the free end 36A of the compound second diverter fin 36 is pointing in a direction substantially parallel to the rear or downstream side of the ballast tank 24 and the first diverter fin assembly 32. Immediately adjacent the outer end 38 of the ballast tank 24, and adjoining the outer end of the first diverter fin assembly 32 the compound second diverter fin 36 presents a concave surface 36B at the upstream side of the skimmer-diverter assembly 20. Thereafter, the compound second diverter fin 36 presents a convex surface 36C from the transition point with the concave surface 36B all the way to the free end 36A thereof. As best shown in FIG. 1, a flow gate 36D is provided in the major portion of the upstream segment of the convex surface 36C, to permit access therethrough of current flow in the pool for the purpose of diverting flow along the inner surface of the convex surface 36C, past the free end 36A and parallel to the downstream side of the skimmer-diverter assembly 20 in its operative position and to provide a reaction surface to that current, such that when the flexible link 34 is released from the pool wall W, the entire skimmer-diverter assembly 20 will be forced by that current into a position adjacent the pool wall W and downstream from the trap chamber therein.

Figure 7:
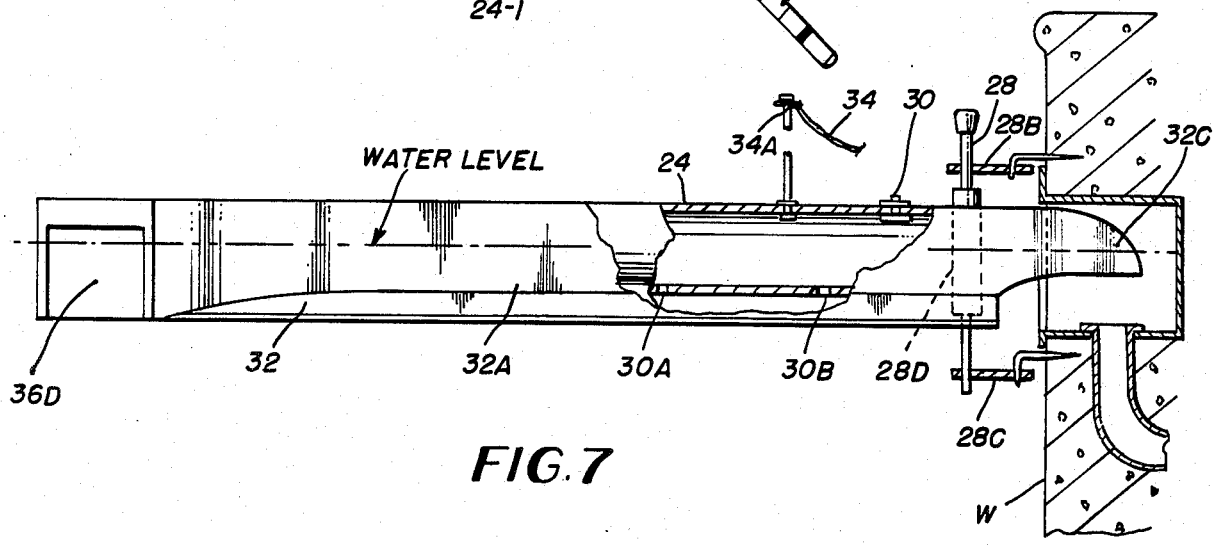
FIG. 7 is a partial front elevation in enlarged scale illustrating the mounting means for securing the assembly of the present invention to the wall of a swimming pool.
Figure 8:
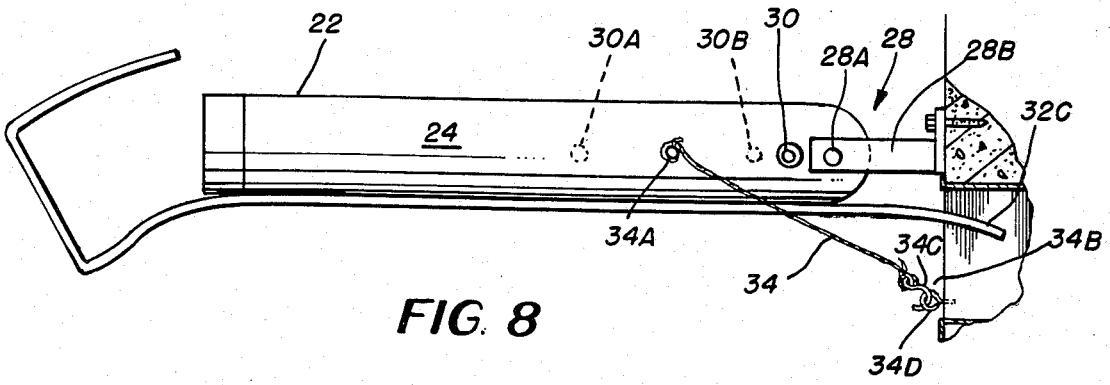
FIG. 8 is a top plan view of the elevation of FIG. 7.

Referring next to FIGS. 7 and 8, the details of the hinge assembly 28 and flexible link 34 together with enlarged partial details of the first flow diverter 32 are clearly shown. The hinge assembly or mounting assembly 28 is shown as including a spindle or hinge pin 28A which is received at its upper and lowermost extremities in brackets 28B and 28C, respectively, with the intermediate portion of the pin 28A including an enlarged sleeve or cylindrical T-section 28D integrally formed with the inboard end of the floating ballast boom 24. The enlarged central sleeve portion 28D does not extend the full distance between the brackets 28B and 28C so as to permit vertical movement of the hinge pin 28A in the said brackets due to flotation of the ballast boom 24 and the variation in the position of the water level in the pool with respect to the trap chamber as shown in FIG. 7.

As further can be seen from FIGS. 7 and 8, the flexible link 34 is fixed at one end to the ballast arm 24 by means of a vertically extending post 34A and carries a hook or other suitable connecting means 34C at its opposite end which cooperates with a screw eye or the like 34D on the pool wall W adjacent the trap chamber as best shown in FIG. 8.

As also illustrated in FIGS. 7 and 8, there is an air valve 30 positioned in the top surface of the floating ballast arm 24 which may be in the form of a petcock, which cooperates with one or more holes such as 30A and 30B drilled in the submerged lowermost portion of the ballast boom 24 to permit the ingestion of water into the boom as air is permitted to escape through the valve 30 to thereby adjust the buoyancy and flotation level of the entire assembly 22.

Figure 4:
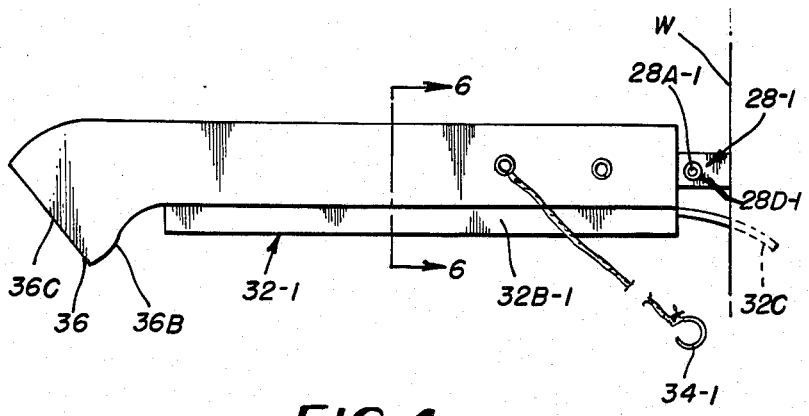
FIG. 4 is a top plan view of another preferred embodiment of the present invention.
Figure 5:
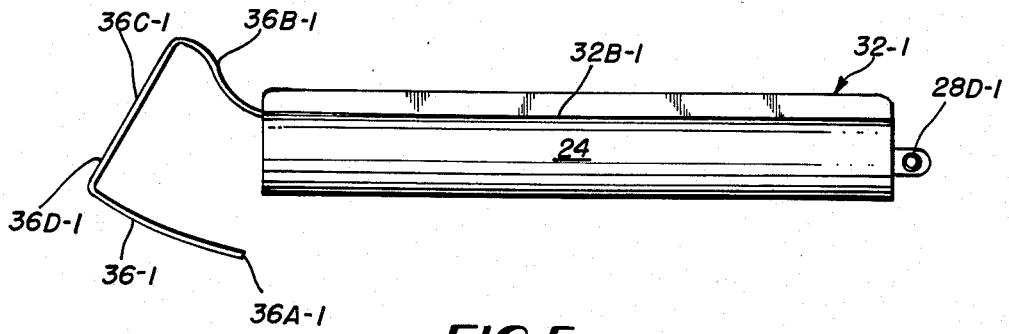
FIG. 5 is a bottom plan view of the embodiment of FIG. 4.
Figure 6:
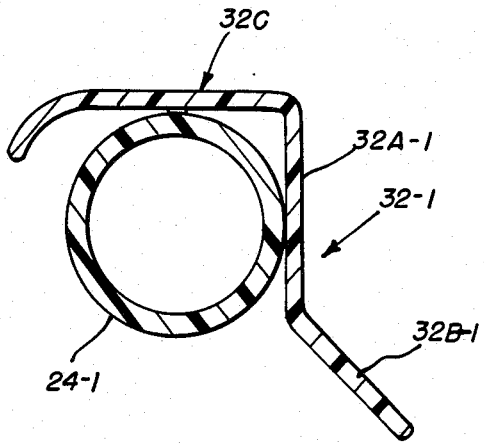
FIG. 6 is a cross-section taken along line 6—6 of FIG. 4.

An alternate embodiment of the present invention is partially illustrated in FIGS. 4, 5 and 6 in which the entire diverter structure is molded from a single piece of plastic or the like such that there are no sharp or protruding edges providing a structure which can be both inobtrusive and remain in the pool without departing the use thereof. Like portions of the embodiments of FIGS. 4, 5 and 6 to those of the embodiments of FIGS. 1–3, 7 and 8 carry like numerals with the suffix-1. The primary difference in the two embodiments is that there is a complete unitary top shield 32C which covers both the compound curved second diverter fin 36-1 and the floating ballast boom 24-1.

OPERATION OF THE INVENTION

Figure 9:
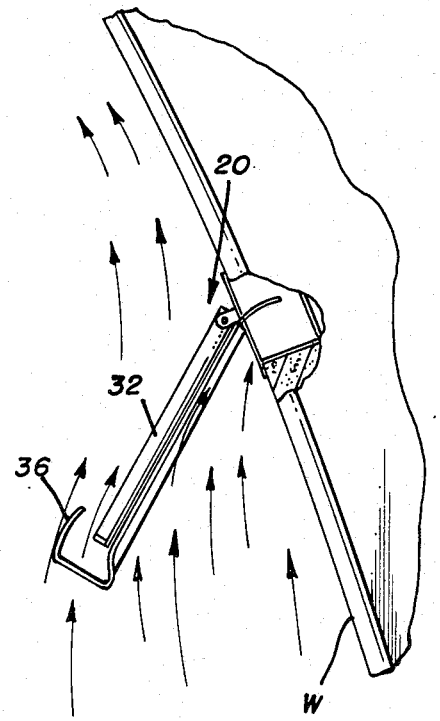
FIG. 9 is a schematic illustration of a skimmer-diverter assembly of the present invention in operative position in a pool.
Figure 10:
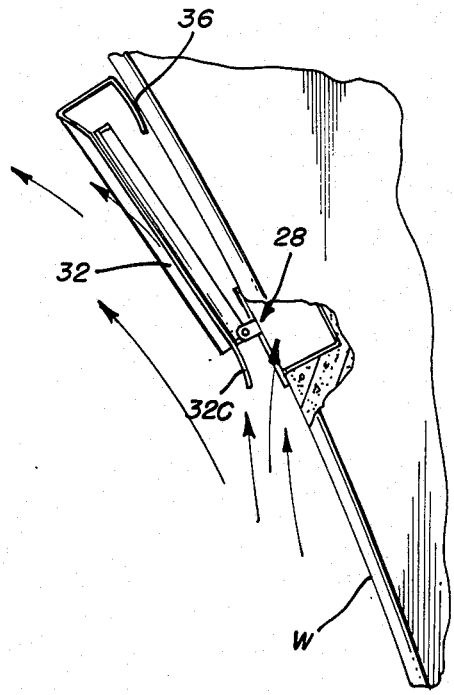
FIG. 10 is a schematic illustration of a skimmer-diverter assembly of the present invention in a retracted position in a pool.

Referring to FIGS. 1, 2, 9 and 10, the operation of the present invention will now be described. As shown in FIG. 1, a series of flow patterns results from the operative position of the skimmer-diverter assembly 20 which is illustrated in FIG. 9 and FIG. 2 as being disposed at an angle (FIG. 9) with respect to the pool wall of about 55 degrees in a preferred embodiment. This acute angle with respect to the pool wall results in a diversion of the current flow in the swimming pool as illustrated by the flow arrows in FIG. 1 and FIG. 9 as follows:

Current flow striking the outermost portion 36C of the compound second flow diverter fin 36 travels around the exterior of the compound flow diverter fin 36 in a turbulent flow as illustrated. Current flow entering the gate portion 36D of the compound flow diverter 36 impinges upon the interior rear surface and exits past the terminal edge 36A of the compound flow diverter fin 36 in a direction substantially parallel to the downstream side of the floating ballast boom 24. Thus, any debris entrained in the current and flowing through the gate 36D is captured by the current and directed towards the pool wall W such that on the next pass around the pool it can engage the first flow diverter 32 and be carried into the trap chamber of the pool skimmer. Current flow which directly impinges upon the first flow diverter fin 32 engages both the lower upwardly angled surface 32B and the vertical surface 32A thereof to cause both an upward and inward flow direction such that debris entrained in those currents is passed along the upstream side of the floating arm assembly 22 into the trap chamber of the pool skimmer.

Assuming that the pool is now clean and swimmers wish to utilize the pool, the flexible link 34 is unhooked from the screw eye 34D and released whereupon the force of the current flowing in the pool against both the first diverter fin 32 and the compound flow diverter fin 36 forces the skimmer-diverter assembly 20 about the hinge pin 28A towards the pool wall W downstream of the trap chamber of the pool skimmer. As the floating arm assembly 22 approaches the pool wall W, the flow of current in the pool through the gate portion 36D of the compound second flow diverter fin 36 reverses and flows from the formerly trailing terminal edge 36A backwards through the gate 36D causing a reaction which forces the floating arm assembly 22 even closer to and maintains it proximate with the the pool wall W in response to the action of the pool current.

Thus, the skimmer-diverter assembly 20 will remain in an inobtrusive and unimpairing position adjacent the pool wall so long as the pool circulation system and skimmer are energized without the need to permanently or actively tether the assembly in that position. Then, when it is desired to remove surface debris from the pool, the flexible link 34 is utilized to draw the floatation arm assembly 22 away from the pool wall W and place it back into the operative position illustrated in FIGS. 1 and 9 to thereby commence entraining floating debris in the diverted current and directing it into the trap chamber. This position is maintained by reengaging the hook 34C on the end of the flexible link with the screw eye 34D at the position 34B on the pool wall W.

As another alternative construction to the hooded construction of FIGS. 4, 5 and 6, the first flow diverter 32 and compound second flow diverter 36, if left in an open configuration, may be manufactured from an elastomeric material which need only be of sufficient rigidity to divert current but which may be sufficiently flexible so as to give in response to an impact thereby precluding an injury to a swimmer who might accidentally engage that portion of the assembly.

The present invention having been thus described, it should be apparent that modifications could be made to the various components of the system, as would occur to one of ordinary skill in the art without departing from the spirit and scope of the present invention.

I claim:

1. A skimmer-diverter assembly for swimming pools and the like having a water circulation and filtration system and a skimmer intake at a side wall thereof and having an established flow direction of circulation, said assembly comprising:

an elongated floating arm portion having one and thereof adapted to be positioned adjacent the downstream side of a said skimmer intake and an opposite end;

mounting means on said one end for pivotally mounting said assembly adjacent a said skimmer intake to permit said opposite end to be positioned, selectively, away from and adjacent to a said side wall;

first flow diverting means on said floating arm portion extending from a position above the water surface in said pool to a position below said water surface and constraining water circulating in said established direction of circulation to flow both upwardly and inwardly along the upstream side of said arm portion and into a said skimmer intake when the opposite end of said arm portion is away from said side wall and said arm is angled acutely with respect to said wall into the said direction of circulation to effect an operative position thereof;

second flow diverting means on said other end of said arm portion extending from a position above to a position below the said water surface for enhancing the flow inward along said arm and including means for constraining an enhanced flow inwardly along the downstream side of said arm when said arm is in said operative position; and retaining means for selectively retaining said arm portion in said operative position.

2. The skimmer-diverter assembly of claim 1, wherein said second flow diverting means is further responsive to release of said arm portion from said retaining means and to the flow of water circulating in a said pool to constrain said arm portion to pivot in said mounting means and assume a wall adjacent position in said pool downstream of a said skimmer intake to effect a retracted position of said assembly.

3. The skimmer-diverter assembly of claim 1, wherein said first flow diverting means comprises an elongated upright surface portion substantially coextensive with said arm portion and substantially orthogonal to the surface of said water and an elongated submerged surface portion substantially coextensive with and extending beneath said upright surface portion and having the lowermost edge thereof upstream of said upright surface in said operative position of said assembly.

4. The skimmer-diverter assembly of claim 3, wherein said mounting means permits vertical displacement of said assembly.

5. The skimmer-diverter assembly of claim 4, wherein said second flow diverting means is further responsive to release of said arm portion from said retaining means and to the flow of water circulating in a said pool to constrain said arm portion to pivot in said mounting means and assume a wall adjacent position in said pool downstream of a said skimmer intake to effect a retracted position of said assembly.

6. The skimmer-diverter assembly according to claim 3, wherein said second flow diverting means is further responsive to release of said arm portion from said retaining means and to the flow of water circulating in a said pool to constrain said arm portion to povit in said mounting means and assume a wall adjacent position in said pool downstream of a said skimmer intake to effect a retracted position of said assembly.

7. The skimmer-diverter assembly according to claim 1, wherein said second flow diverting means comprises a hydrofoil having a concave-convex leading edge portion substantially orthogonal to the said surface of the said water with the concave portion thereof adjacent said first flow diverting means and the convex portion thereof being upstream of said concave portion in sid operative position; and said constraining means of said second diverter means comprises a trailing edge portion orthogonal to said water surface and curved to constrain circulating water in said pool to flow along the downstream side of said arm position in said operative position.

8. The skimmer-diverter assembly according to claim 7, wherein said second flow diverting means is further responsive to release of said arm portion from said retaining means and to the flow of water circulating in a said pool to constrain said arm portion to pivot in said mounting means and assume a wall adjacent position in said pool downstream of a said skimmer intake to effect a retracted position of said assembly.

9. The skimmer-diverter assembly according to claim 7, wherein said trailing edge portion includes an upstream surface portion and is formed as a continuous curved structure with said leading edge portion, terminating adjacent the said other end of said arm portion; and said leading edge portion includes flow gate means defined therein for ingesting water flowing in a said pool and permitting said ingested water to engage said upstream surface portion of said trailing edge to constrain inward flow thereof along the downstream side of said arm portion in said operative position.

10. The skimmer-diverter assembly according to claim 9, wherein said second flow diverting means is further responsive to release of said arm portion from said retaining means and to the flow of water circulating in a said pool to constrain said arm portion to pivot in said mounting means and assume a wall adjacent position in said pool downstream of a said skimmer intake to effect a retracted position of said assembly.

11. The skimmer-diverter assembly according to claim 10, wherein said concave-convex leading edge includes a rear surface; and said rear surface of said leading edge, said upstream surface of said trailing edge and said flow gate means are responsive to the flow of water in a said pool to constrain said assembly to assuem said retracted position upon release of said arm portion from said retaining means.

12. The skimmer-diverter assembly according to claim 3, wherein said first flow diverting means comprises an elongated upright surface portion substantially coextensive wit said arm portion and substantially orthogonal to the surface of said water and an elongated submerged surface portion substantially coextensive with and extending beneath said upright surface portion and having the lowermost edge thereof upstream of said upright surface portion in said operative position of said assembly.

13. The skimmer-diverter assembly according to claim 12, wherein said second flow diverting means is further responsive to release of said arm portion from said retaining means and to the flow of water circulating in a said pool to constrain said arm portion to pivot in said mounting means and assume a wall adjacent position in said pool downstream of a said skimmer intake to effect a retracted position of said assembly.

14. The skimmer-diverter assembly according to claim 12 wherein said trailing edge portion includes an upstream surface portion and is formed as a continuous curved structure with said leading edge portion, terminating adjacent the said other end of said arm portion; and said leading edge portion includes flow gate means defined therein for ingesting water flowing in a said pool and permitting said ingested water to engage said upstream surface portion of said trailing edge to constrain inward flow thereof along the downstream side of said arm portion in said operative position.

15. The skimmer-diverter assembly according to claim 14, wherein said second flow diverting means is further responsive to release of said arm portion from said retaining means and to the flow of water circulating in a said pool to constrain said arm portion to pivot in said mounting means and assume a wall adjacent position in said pool downstream of a said skimmer intake to effect a retracted position of said assembly.

16. The skimmer-diverter assembly according to claim 15 wherein said concave-convex leading edge includes a rear surface; and said rear surface of said leading edge, said upstream surface of said trailing edge and said flow gate means are responsive to the flow of water in a said pool to constrain said assembly to assme said retracted position upon release of said arm portion from said retaining means.

17. The skimmer-diverter assembly of claim 1, wherein said floating arm portion includes a ballast boom having a ballast chamber defined therein; vent means in said boom permitting ingress and egress of water to and from said ballast chamber; and valve means controlling the level of water in said chamber and the degree of flotation of said floating arm portion.

18. The skimmer-diverter assembly of claim 17, wherein said second flow diverting means is further responsive to release of said arm portion from said retaining means and to the flow of water circulating in a said pool to constrain said arm portion to pivot in said mounting means and assume a wall adjacent position in said pool downstream of a said skimmer intake to effect a retracted position of said assembly.

19. The skimmer diverter assembly of claim 17, wherein said first flow diverting means comprises an elongated upright surface portion substantially coextensive with said arm portion and substantially orthogonal to the surface of said water and an elongated submerged surface portion substantially coextensive with and extending beneath said upright surface portion and having the lowermost edge thereof upstream of said upright surface portion in said operative position of said assembly.

20. The skimmer-diverter assembly of claim 19, wherein said mounting means permits vertical displacement of said assembly.

21. The skimmer-diverter assembly of claim 20, wherein said second flow diverting means is further responsive to release of said arm portion from said retaining means and to the flow of water circulating in a said pool to constrain said arm portion to pivot in said mounting means and assume a wall adjacent position in said pool downstream of a said skimmer intake to effect a retracted position of said assembly.

22. The skimmer-diverter assembly of claim 19, wherein wherein said second flow diverting means is further responsive to release of said arm portion from said retaining means and to the flow of water circulating in a said pool to constrain said arm portion to pivot in said mounting means and assume a wall adjacent position in said pool downstream of a said skimmer intake to effect a retracted position of said assembly.

* * * * *

UNITED STATES PATENT AND TRADEMARK OFFICE

CERTIFICATE OF CORRECTION

PATENT NO. : 4,789,470

DATED : December 6, 1988

INVENTOR(S) : John F. Ward

It is certified that error appears in the above-identified patent and that said Letters Patent is hereby corrected as shown below:

Cover Page: Item (19) "Wards" should read --Ward--

Item (76) Inventor: "Wards" should read --Ward--.

In the Specification:

Column 3, Line 17 change "he ing" to --hinge--.
Column 3, Line 29 change "vertical" to --vertically--.

In the Claims:

Column 6, Line 16 change "and" to --end--.
Column 7, Line 8 change "povit" to --pivot--.
Column 7, Line 18 change "sid" to --said--.
Column 7, Line 60 change "assuem" to --assume--.
Column 7, Line 66 change "wit" to --with--.
Column 8, Line 41 change "assme" to --assume--.
Column 10, Line 4 delete "wherein" (second occurence).

Signed and Sealed this

Fourth Day of July, 1989

*Attest:*

*Attesting Officer*

DONALD J. QUIGG

*Commissioner of Patents and Trademarks*